United States Patent [19]

Laspeyres

[11] Patent Number: 4,799,879

[45] Date of Patent: Jan. 24, 1989

[54] RADIANT BURNERS WITH A CERAMIC FRAME

[75] Inventor: Marc Laspeyres, Herlies, France

[73] Assignee: Solaronics Vaneecke, Armentieres, France

[21] Appl. No.: 162,171

[22] Filed: Feb. 29, 1988

Related U.S. Application Data

[63] Continuation-in-part of Ser. No. 803,159, Dec. 2, 1985, abandoned.

[51] Int. Cl.[4] ..... F23D 14/12

[52] U.S. Cl. ..... 431/328

[58] Field of Search ..... 431/328, 329, 326, 346; 126/92 B, 92 AC

[56] References Cited

U.S. PATENT DOCUMENTS

| | | | |
|---|---|---|---|
| 3,107,720 | 10/1963 | Van Swinderen | 431/346 X |
| 3,155,142 | 11/1964 | Stack | 431/328 |
| 3,217,701 | 11/1965 | Weiss | 431/328 X |
| 4,421,476 | 12/1983 | Gulden et al. | 431/328 X |
| 4,654,000 | 3/1987 | Smith | 431/328 |

FOREIGN PATENT DOCUMENTS

| | | | |
|---|---|---|---|
| 2322181 | 11/1973 | Fed. Rep. of Germany . | |
| 2306009 | 8/1974 | Fed. Rep. of Germany . | |
| 187513 | 11/1982 | Japan | 431/328 |

*Primary Examiner*—Randall L. Green

*Attorney, Agent, or Firm*—Frost & Jacobs

[57] ABSTRACT

A radiant burner comprising a screen and a radiant plate enclosed by a peripheral band and associated with a body defining the premixing chamber. In said burner, there is provided, bearing against an upper flange of the band, a ceramic frame having an internal peripheral structure which enables the grate to be supported. Provision being also made of resilient means.

10 Claims, 3 Drawing Sheets

RADIANT BURNERS WITH A CERAMIC FRAME

RELATED APPLICATIONS

This is a continuation-in-part of application Ser. No. 803,159 filed Dec. 2, 1985, now abandoned.

BACKGROUND OF THE INVENTION

Technical Field

The invention relates to the field of radiant burners. It is concerned more particularly with a radiant burner provided with a ceramic frame.

Hitherto, radiant burners consisted of a body defining a premixing chamber, on which body one (or several) plate(s) was (were) arranged, for example, with a honey-combed radiating surface above which a grate may or may not have been arranged, these three elements being fixed together, where necessary, by suitable means. These various elements were assembled from the top, i.e. the grate was fixed to the body last of all, using the said means.

Such an arrangement in which the grate and the plate were in direct contact with the body gave rise to considerable heat losses and, moreover, thermal stresses due to local overheating caused the grate and the plate to deteriorate more rapidly.

An object of the present invention is to propose a radiant burner which has a design different from that of the radiant burners of the prior art and which overcomes, to a very large extent, the abovementioned drawbacks resulting from the thermal stresses and the heat losses.

Another object of the invention is to provide a radiant burner, the design of which makes it possible to achieve improved outputs in terms of the energy radiated.

Yet another object of the present invention is to provide a radiant burner, assembly of which is easier and more practical than that of the radiant burners of the prior art.

Therefore, the object of the present invention is to propose a new radiant burner which has the advantage, in terms of heat, of limiting the lateral heat losses and, therefore, the rear heat losses occurring via conduction, which burner enables the thermal energy to be concentrated better inside the combustion chamber, thereby resulting in a greater amount of energy radiated at the front of the burner. An essential characteristic feature of this burner consists in the fact that it is provided with an internal peripheral frame made of ceramic material inside the front of the burner

SUMMARY OF THE INVENTION

The present invention is concerned more particularly with a radiant burner of the type comprising a screen and at least one radiant plate enclosed by a peripheral band itself associated with a body defining a premixing chamber for the said burner. Said burner comprises an upper flange on the peripheral band, a ceramic frame underlying and extending downwardly from said upper flange on said peripheral band, said ceramic frame having an internal peripheral structure which engages and supports at least said screen, said internal peripheral structure permitting limited movement of said screen to minimize thermal and mechanical stresses thereon, and a resilient means integrally affixing said peripheral band to said body.

Said resilient means comprises four helical compression springs surrounding respectively the body of four bolts and bearing by one end on the head of each bolt and by the other end on a sleeve surrounding the bolt and bearing against the lateral flanges of a longitudinal back plate integral with the body of the burner, said bolts extending through said flanges and being screwed on lateral beams affixed to the peripheral band. Said arrangement enables in operation a detrimental clearance between the constitutive parts of the burner to be avoided. Suitable adjustment may be made by screwing the bolts.

According to an embodiment of the invention, the ceramic frame consists of a continuous molding having at least one internal channel.

According to a variation of this embodiment, the ceramic frame has a continuous profile having, moreover, an upper shoulder on its inner face.

According to a second embodiment of the invention, the ceramic frame consists of profiled bars having each at least one internal support channel.

According to a first alternative form of this second embodiment, the ceramic frame consists of profiled bars having each an upper shoulder intended to receive the grate.

According to a second alternative form of this second embodiment, the ceramic frame has a lower shoulder for receiving the radiant plate and an underlying peripheral channel inside which the grate is accommodated.

Other characteristic features and advantages of the invention will become apparent upon reading the non-limiting description of several embodiments of the radiant burner with a ceramic frame according to the invention, given with reference to the attached drawings in which:

DETAILED DESCRIPTION OF THE PREFERRED EMBODIMENT

Figure 1:
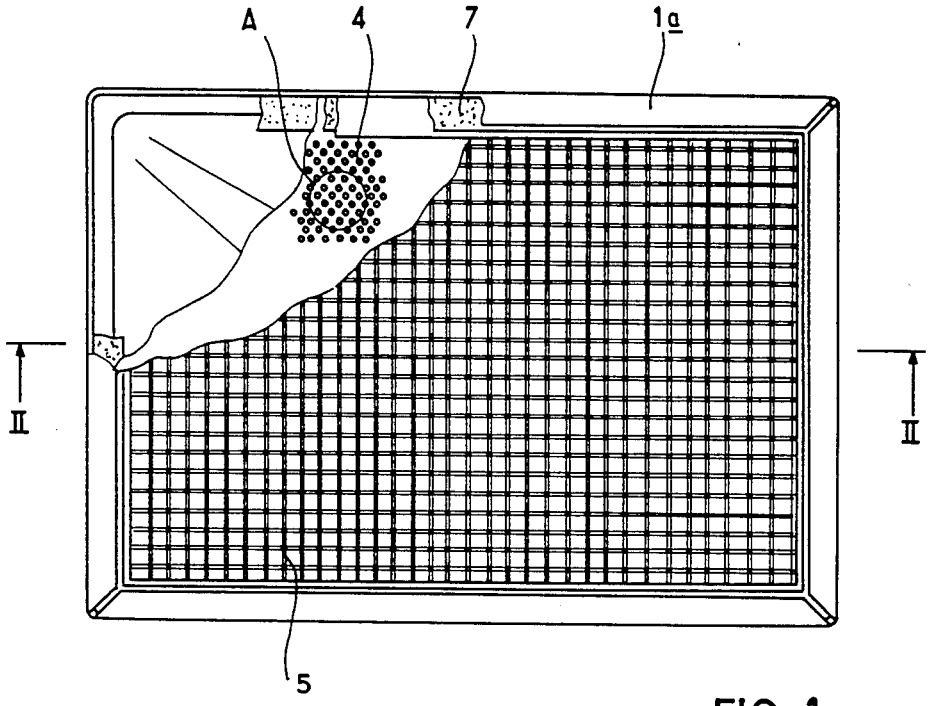
FIG. 1 is a partially cut-away plan view of a radiant burner according to the present invention.
Figure 2:
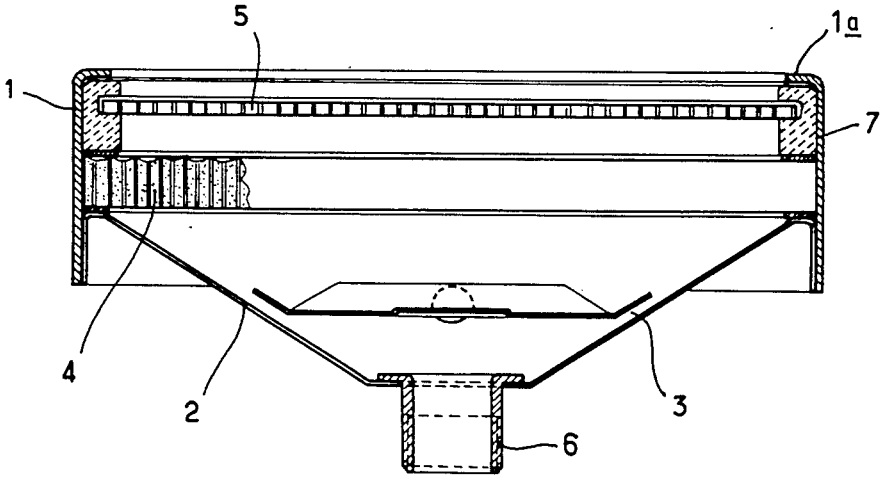
FIG. 2 is a sectional view along the line II—II of FIG. 1.

As shown in FIGS. 1 and 2, the radiant burner according to the invention consists of a peripheral band 1, the bottom part of which is fixed to a burner body 2 and which defines a premixing chamber and has internally a deflecting structure 3. A radiant plate 4 is also placed on body 2, on which plate a ceramic frame 7 rests, the upper face of which is in close contact with band 1 and has on its inner face a groove or peripheral channel 7*a* inside which the screen 5 engages. This ceramic frame 7 (resting against the radiant plate 4) is held in place by the inner flange 1*a* of band 1. A connection-piece 6 is fixed to the bottom opening in the body 2.

Figure 3:
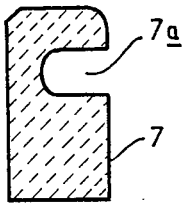
FIG. 3 is a cross-sectional view of a ceramic frame element, according to the invention.

FIG. 3 shows on an enlarged scale, and in cross-section, a member of the ceramic frame 7 with its groove intended to receive the outer zone of the radiant screen 5.

Figure 4:
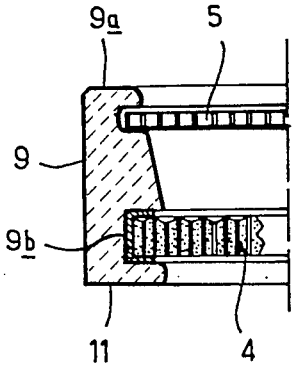
FIG. 4 is a cross-sectional view of another embodiment of ceramic frame elements, according to the invention.

In the embodiment shown in FIG. 4, the element 9 of the ceramic frame has an upper channel 9*a* intended to receive the peripheral edge of the radiant screen 5, and a lower channel 9*b* intended to receive the peripheral zone of radiant plate 4 and provided with a ceramic seal 11. It will be noted that the thickness of the ceramic member decreases from its lower edge to the upper edge of the channel 9*b*.

Figure 5:
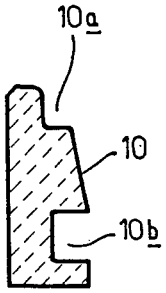
FIG. 5 is a cross-sectional view of a third embodiment of a ceramic frame according to the invention.

In the embodiment shown in FIG. 5, the member of the ceramic frame has substantially the same shape as the ceramic member shown in FIG. 4, in particular as regards the respective channels 9*b* and 10*b* of the bodies 9 and 10. However channel 9*a* is replaced by a shoulder 10*a* on which radiant screen 5 rests.

Figure 6:
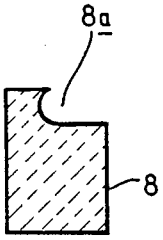
FIG. 6 is a cross-sectional view of a fourth embodiment of a ceramic frame, according to the invention.

In the embodiment shown in FIG. 6, the ceramic frame member 8 has an upper shoulder 8*a* for receiving the radiant screen 5.

Figure 8:
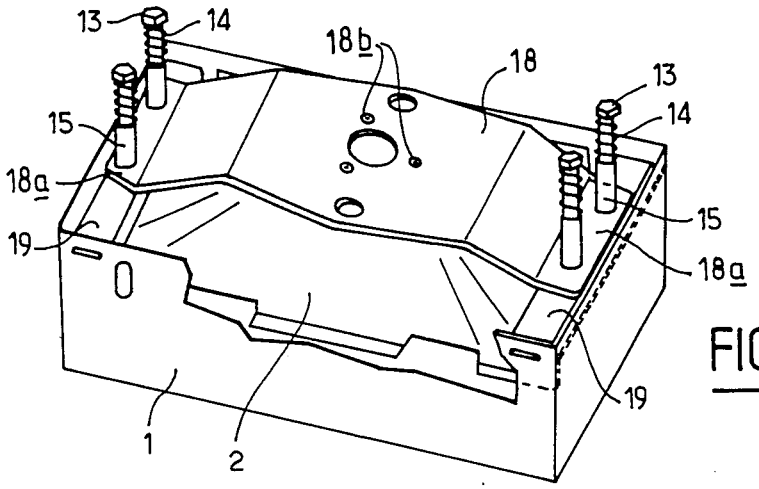
FIG. 8 is a perspective view showing another embodiment of the radiant burner according to the present invention.
Figure 9:
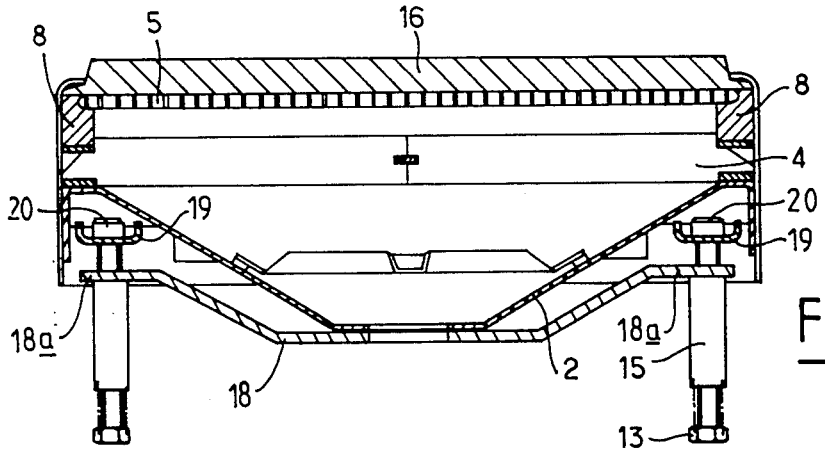
FIG. 9 is a cross-sectional view of the radiant burner of FIG. 8 along the line IX—IX in FIG. 10.
Figure 10:
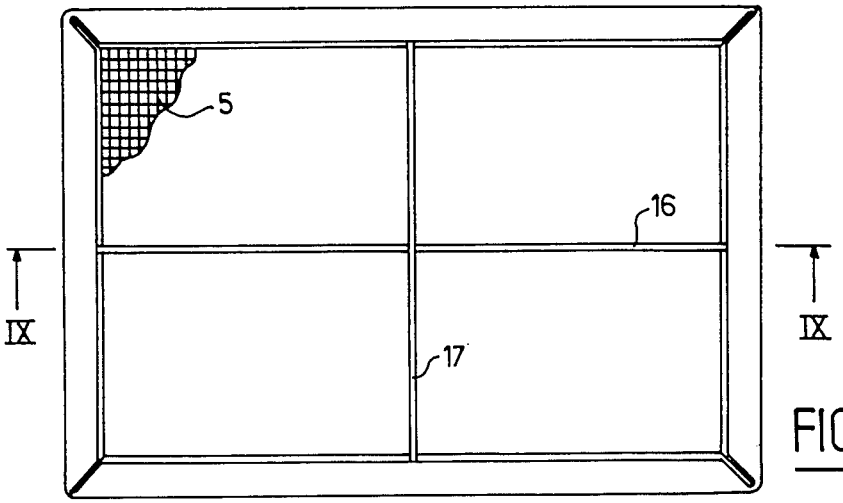
FIG. 10 is a front view of the radiant burner of FIG. 8.

In the embodiment shown in FIGS. 8–10, a back plate 18 is secured to the burner body 2 by means of rivets 18*b*. Said plate 18 comprises two flanges 18*a* each provided with projecting four studs 15 through which are passing bolt stems 14 surrounded by compression springs abutting on the one hand against the bolt head 13 and on the other end on the free ends of the studs 15. Said bolts 13 cooperate with nuts 20 secured to transversal beams 19 which are mounted on the peripheral band 1. The screen 5 is divided by a longitudinal bar 16 in cross relationship with a lateral bar 17. Thus by acting on the bolts 13, it is possible to avoid any detrimental clearance between the constitutive parts of the radiant burner, that could occur in operation.

Figure 7:
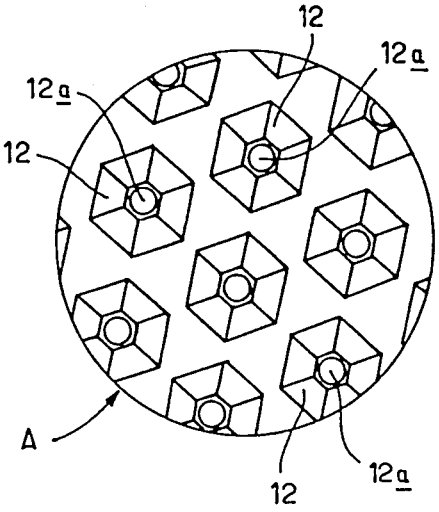
FIG. 7 is a plan view of a detail A of the radiant plate incorporated in the burner.

As shown in FIG. 7, the radiant plate 4 has, in the case of a honey-combed radiating surface, a structure which comprises a plurality of cells 12 having a hexagonal structure with a sole central hole 12*a*.

As regards the materials from which the radiant burner is made, it will be noted that the radiant plate is made of refractory material, for example with a ceramic base, and the screen is made of a heat-resistant alloy, for example an Ni/Cr alloy in the ratio of 70% to 30%, respectively. Although the constitutive members of the ceramic frame may be obtained by extruding ceramic material, it is preferable to mold them so as to comply more rigidly with manufacturing standards, without excluding the possibility of rectification.

It will be noted that the various constitutive members of the radiant burner according to the invention may be assembled by stacking them either from the top or from the bottom, the operation being performed automatically without the need for any assembly parts.

In addition to the abovementioned advantages resulting from control and reduction of the thermal stresses, the technological advantages provided by the structure of the radiant burner according to the invention will be readily apparent:

freedom of movement of the screen inside the groove when expansion stresses occur; and the body burner;

thermal insulation of the screen with respect to the other constituent parts;

thermal insulation of the combustion chamber with respect to the constituent parts not involved in producing radiation, such as the metal band for example; and elimination of the mechanical stresses exerted on the plate(s).

It is obvious that the invention is in no way limited to the forms and embodiments described above; it embraces all modifications and variations thereof, originating from the same basic principle. Thus, it is possible to use all heat-resistant compositions and alloys for the constituent parts of the radiant burner according to the invention, provided that they possess characteristics suited for the application.

What I claim is:

1. In a radiant burner of the type comprising a screen and at least one radiant plate enclosed by a peripheral band associated with a body defining a premixing chamber for the said burner, the improvement comprising:

an upper flange on the peripheral band, a ceramic frame underlying and extending downwardly from said upper flange on said peripheral band, said ceramic frame having an internal peripheral structure which engages and support at least said screen and possibly said plate to be supported, said internal peripheral structure permitting limited movement of said screen to minimize thermal and mechanical stresses thereon, and a resilient means integrally affixing said peripheral band to said body.

2. The radiant burner as set forth in claim 1, wherein the ceramic frame is a continuous molding and said internal peripheral structure comprises at least one internal channel.

3. The radiant burner as set forth in claim 1, wherein the ceramic frame comprises a continuous profile with an upper shoulder and a peripheral channel on its inner face.

4. The radiant burner as set forth in claim 1, wherein said ceramic frame comprises profiled members having at least one internal support channel.

5. The ceramic burner as set forth in claim 1, wherein said ceramic frame comprises profiled members having an upper shoulder.

6. The radiant burner as set forth in claim 1, wherein said ceramic frame comprises profiled members having an upper peripheral channel and a lower peripheral channel.

7. The ceramic burner as set forth in claim 1, wherein said ceramic frame comprises profiled bars having an upper shoulder and a lower peripheral channel.

8. The ceramic burner as set forth in claim 1, wherein the resilient means comprises four compression springs each surrounding respectively the body of a bolt and bearing by one end on a sleeve surrounding the bolt body and by the other end on the head of the bolt, the sleeves being secured to the lateral flanges of a back plate mounted integral to the body of the burner.

9. The ceramic burner as set forth in claim 8, wherein the bolt bodies pass through the lateral flanges of said back plate and are screwed on lateral beams affixed to the peripheral band.

10. The radiant burner as set forth in claim 1, wherein said radiant plate consists of a radiating honeycombed structure comprising a plurality of cells having a hexagonal structure with a sole central hole.

* * * * *